US006375520B1

(12) United States Patent
Shuey

(10) Patent No.: US 6,375,520 B1
(45) Date of Patent: Apr. 23, 2002

(54) ELECTRICAL POWER INTERFACE CONNECTOR

(75) Inventor: Joseph B Shuey, Camp Hill, PA (US)

(73) Assignee: Berg Technology, Inc., Etters, PA (US)

( * ) Notice: Subject to any disclaimer, the term of this patent is extended or adjusted under 35 U.S.C. 154(b) by 0 days.

(21) Appl. No.: 09/461,591

(22) Filed: Dec. 15, 1999

(51) Int. Cl.[7] ..... H01R 4/10
(52) U.S. Cl. ..... 439/880; 439/877; 439/65
(58) Field of Search ..... 439/877, 880, 439/796, 798, 879, 581, 65; 174/88 R, 84 C, 94 R

(56) References Cited

U.S. PATENT DOCUMENTS

| | | | | |
|---|---|---|---|---|
| 2,210,804 A | * | 8/1940 | Eby | 439/880 |
| 3,015,685 A | * | 1/1962 | Gerlach et al. | 439/879 |
| 3,036,147 A | * | 5/1962 | Wheaton et al. | 439/879 |
| 3,317,887 A | * | 5/1967 | Henschen et al. | 439/879 |
| 3,944,721 A | * | 3/1976 | Reeder | 174/88 R |
| 3,980,380 A | | 9/1976 | Cieniawa et al. | 339/99 |
| 4,283,108 A | | 8/1981 | Fischer | 339/198 |
| 4,749,357 A | | 6/1988 | Foley | 439/80 |
| 4,857,016 A | | 8/1989 | Benscoter et al. | 439/680 |
| 5,358,417 A | | 10/1994 | Schmedding | 439/178 |
| 5,624,272 A | | 4/1997 | Lin | 439/417 |
| 5,807,145 A | | 9/1998 | Deylitz | 439/819 |
| 5,823,796 A | | 10/1998 | Bethurum | 439/76.1 |

FOREIGN PATENT DOCUMENTS

GB 2330250 A 4/1998

* cited by examiner

*Primary Examiner*—Gary Paumen
*Assistant Examiner*—Felix O. Figueroa
(74) *Attorney, Agent, or Firm*—Perman & Green, LLP

(57) ABSTRACT

A method for forming an electrical interface for an electrical cable comprising the steps of providing an electrical connector having a block section, inserting a bare conductor into the block section, and crimping the block section on the bare conductor. The block section of the electrical connector has at least one conductor receiving hole formed in a first end of the block section. The bare conductor of the electrical cable is inserted into the conductor receiving hole of the block section. The block section is made from deformable, conductive material wherein crimping the block section deforms a conductor receiving hole to clamp the conductor inside the hole.

17 Claims, 3 Drawing Sheets

ELECTRICAL POWER INTERFACE CONNECTOR

BACKGROUND OF THE INVENTION

1. Field of the Invention

The present invention relates to electrical connectors and, more particularly, to an electrical power interface connector crimped to an electrical conductor.

2. Brief Description of Earlier Developments

The commercial demand for ever smaller and more powerful electronic devices has fueled the miniaturization of electronic components, such as electrical connectors, used in or with the electronic devices. U.S. Pat. No. 3,980,380 discloses one example of a conventional connector comprising a molded dielectric insert having a plurality of contacts around the periphery of the insert, and a plurality of blind-end conductor retainer apertures into which insulated conductors are inserted. The blind-end apertures intersect insulation piercing self-connection terminal elements of the contacts. The terminal elements are activated into contact with the wires by rotating the insert to cam the terminal elements into the wires. Another example of a conventional connector is disclosed in U.S. Pat. No. 4,749,357, wherein a power distribution connector has an insulating block with a bus element supported therefrom, and a crown-shaped contact located in the block which is electrically connected to the bus element. Still another example of a conventional connector is U.S. Pat. No. 5,807,145 which discloses a break-contact block having two identical half-housings with compartments to accommodate bridge-like contacts and respective springs. A further example of a conventional connector is U.S. Pat. No. 5,358,417 which discloses an electrical connector comprising an elongated plastic housing with holes adapted to receive electrical conductors therein. The plastic housing is heat-staked to retain the conductors therein. Miniaturization of conventional electrical connectors has caused conventional connectors to be very complex in order to ensure an adequate power interface to wire. This is evident in the afore-mentioned examples. The complexity of conventional connectors coupled with their small size has caused the manufacture of the connectors to be labor intensive, and hence, costly. Furthermore, additional reductions in the size of conventional connectors are limited because the effectiveness of the interface between the conductor wire and connector is reduced as the size of the connector decreases. In addition, conventional connectors have contacts which are provided with a tail section having interfacing features, such as bendable tabs, to allow the conductor to be crimped or otherwise attached directly to the contact. These features are time consuming to produce especially for contacts interfacing with small conductors. In addition, due to their small size, these conductor crimping features of contacts in conventional connectors are susceptible to damage during connection of the conductors to the contacts. This may result in an improper or inefficient interface between conductor and contacts which may fail during use. The present invention overcomes the problems of conventional connectors. For instance, in the present invention, conductors need not be crimped directly to the connector contacts to provide an electrical connection therebetween. This is especially advantageous in comparison to conventional connectors wherein direct contact between conductors and contacts is used to effect a connection therebetween. The present invention provides a block section connected to connectors in a manner which is not prone to failure when connected to the conductors, and which is capable of generating much higher clamping forces on the conductors in comparison to crimp tabs on conventional contacts and conventional connectors.

SUMMARY OF THE INVENTION

In accordance with a first method of the present invention, a method for forming an electrical interface for an electrical cable is provided. The method comprises the steps of providing an electrical connector having a block section, inserting a bare conductor in the block section, and crimping the block section on the bare conductor. The block section of the electrical connector has at least one conductor receiving hole formed in a first end of the block section. The bare conductor is inserted into the conductor receiving hole of the block section. The block section is made from a deformable conductive material wherein crimping the block section deforms the conductor receiving hole clamping the conductor inside the hole.

In accordance with a second method of the present invention, a method for manufacturing an electrical connector is provided. The method comprises the steps of forming a conducting block, forming contact receiving holes in the conducting block, and forming at least one conductor receiving hole in the conducting block. The conducting block is formed from a deformable conductive material. The conducting block is a one-piece member. The contact receiving holes are formed in a first end of the conducting block. The conductor receiving hole is formed in a second end of the conducting block. The conductor receiving hole is formed proximate to a side of the conducting block wherein an indentation pressed into the side of the conducting block deforms the conductor receiving hole and crimps the conductor located inside the hole.

In accordance with a first embodiment of the present invention, an electrical connector is provided. The electrical connector comprises an interface block. The interface block has a first end with at least one conductor receiving hole formed therein. The interface block has a second end with contact receiving holes formed therein opposite the conductor receiving hole. The interface block has a side disposed adjacent to the conductor receiving hole. The interface block is made from malleable metal. The side adjacent to the conductor receiving hole is indented for crimping a conductor located inside the conductor receiving hole.

In accordance with a second embodiment of the present invention, an electrical connector is provided. The electrical connector comprises a block section. The block section has a bore formed in one end for receiving a bare conductor therein. The block section has contact receiving holes in an opposite end of the block section for receiving contacts. The block section has a side with an indentation formed by cold pressing a die shape into the side of the block section. The indentation in the side of the block section deforms the bore for crimping the conductor located in the bore to the block section.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
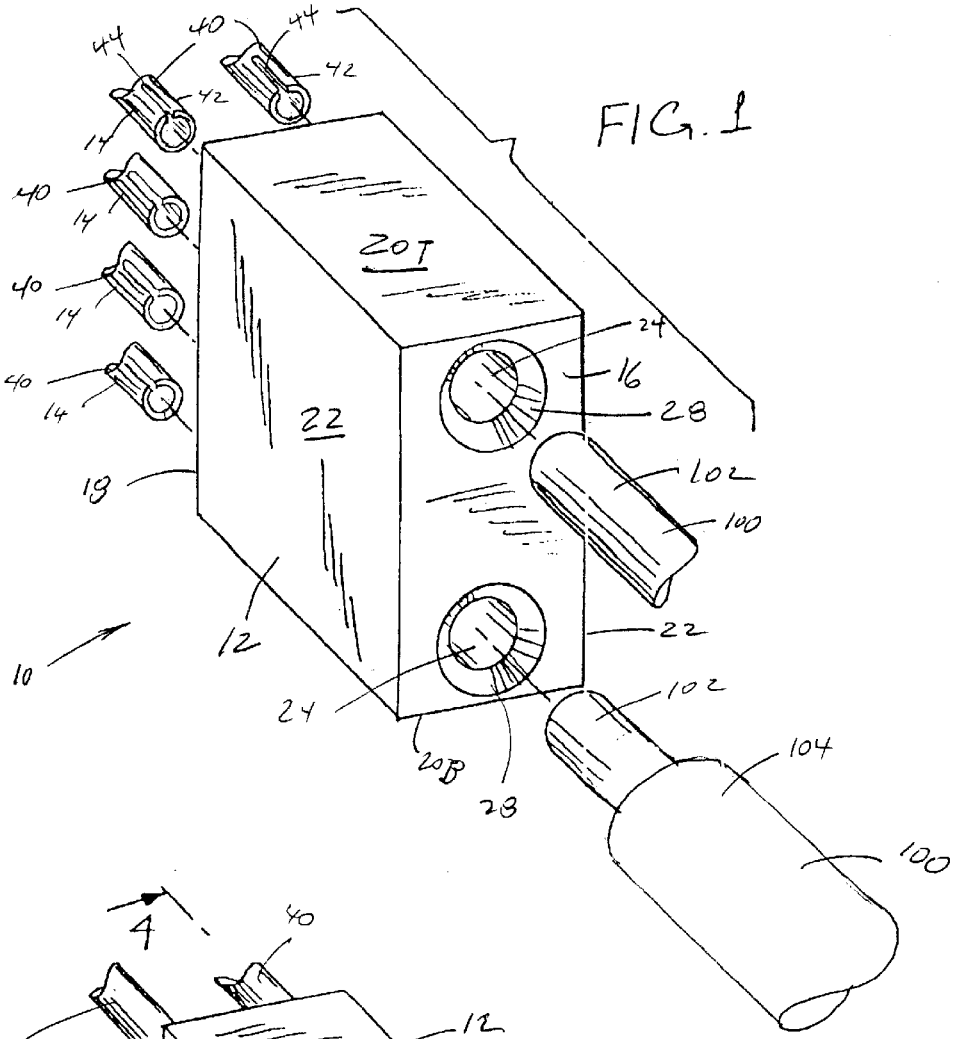
FIG. 1 is an exploded perspective view of an electrical power interface connector incorporating features of the present invention.

Referring to FIG. 1, there is shown an exploded perspective view of an electrical power interface connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
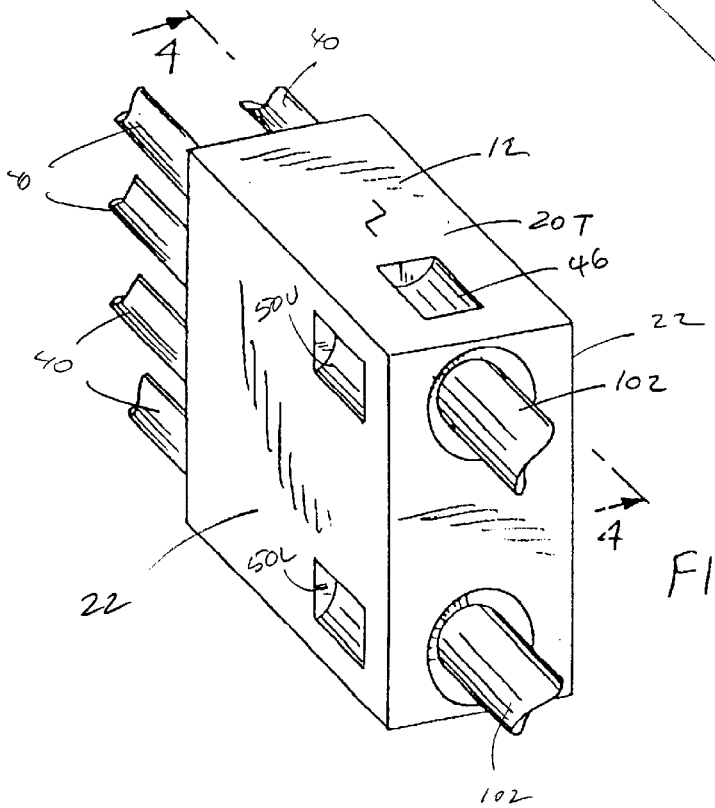
FIG. 2 is a perspective view of the power interface connector in FIG. 1 shown in an assembled configuration connected to electrical conductors.

Referring now also to FIG. 2, the electrical connector 10 generally comprises a block section 12 and contacts 14. The contacts 14 are mounted to the block section 12 to extend from one end thereof. Electrical cables 100, such as cables for transmitting power to an electronic component, are connected to block 12, preferably at an opposite end. Cables 100 and contacts 14 could, however, have another arrangement such as a right angle configuration. The block section 12 forms an electrical connection between the cables 100 and contacts 14 thereby providing a power interface to the cables 100. With the connector 10 mounted to the cables 100, the cables may be connected to a suitable device, such as, a mating connector on an electronic component (not shown) for providing electrical power to the electronic component. The opposite ends (not shown) of cables 100 may be terminated in any suitable manner. The electrical connector 10 may be housed alone or in combination with other similar electrical connectors in an insulating housing (shown in phantom in FIG. 3) to provide a power coupling of desired size and electrical capacity.

Figure 3:
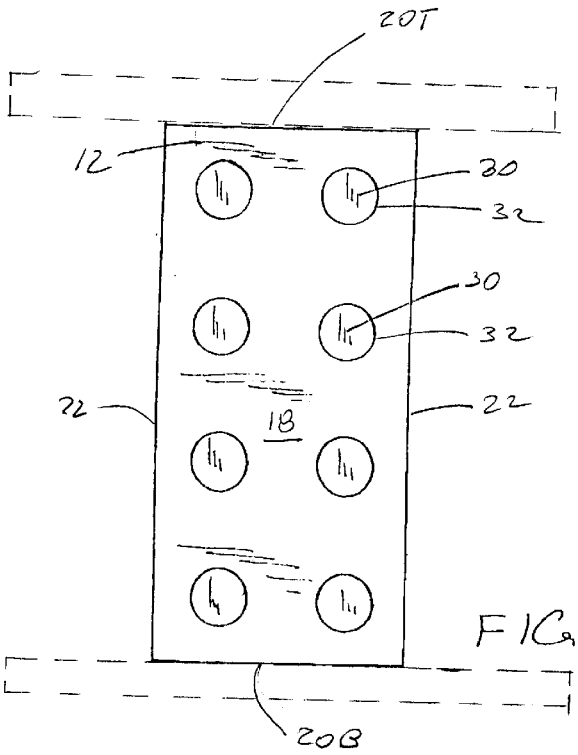
FIG. 3 is an end elevation view of the block section of the power interface connector in FIG. 1.
Figure 4:
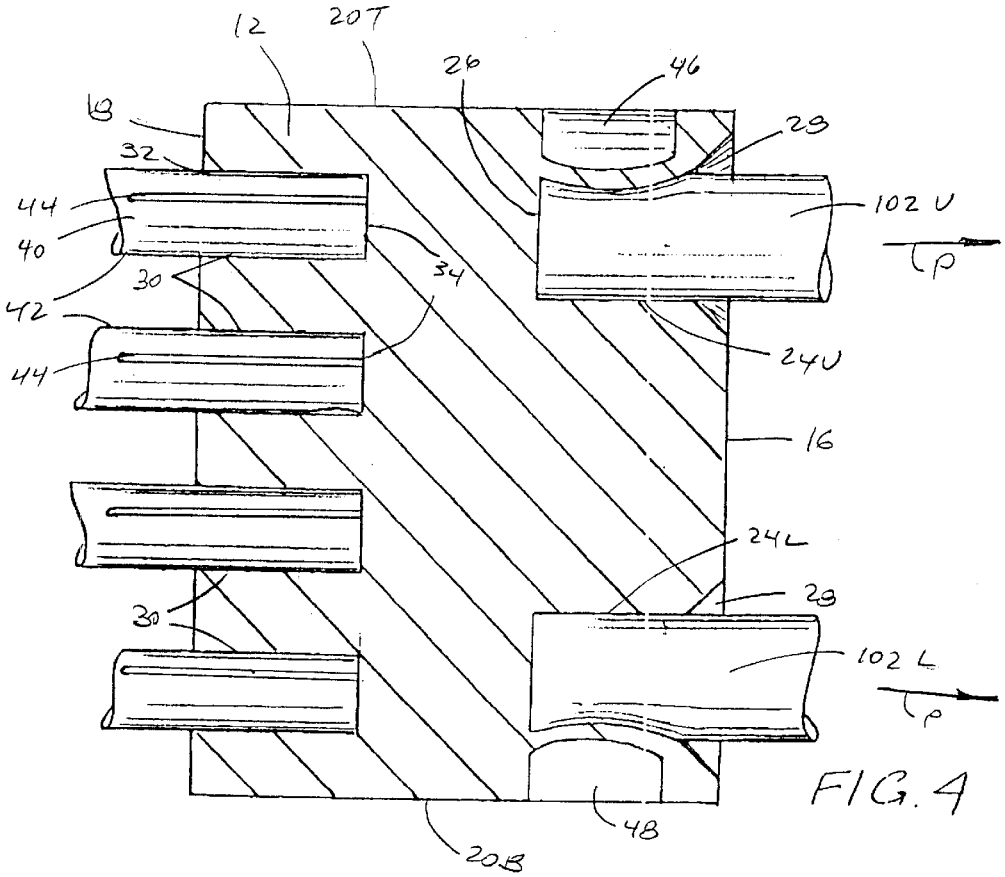
FIG. 4 is a cross-sectional view of the power interface connector in FIG. 1 connected to electrical conductors.

Referring now also to FIGS. 3 and 4, the block section 12 of the electrical connector 10 is preferably a one piece member made from a soft or malleable metal such as brass or tellurium copper. In alternate embodiments, the block section of the connector may be made from any other suitable deformable conductive material. As seen in FIGS. 1 and 4, the block section 12 is a hexahedron with a generally rectangular cross-section. The top and bottom faces 20T, 20B, the side faces 22 and the end faces 16, 18 of the block section 12 are substantially flat. In alternate embodiments, the block section may have any other suitable shape such as a cylindrical shape. In still other embodiments, the sides of the block section may be angled obliquely relative to each other or may have surface features formed therein. The block section 12 has conductor receiving chambers formed therein. As shown in the figures, the block section could have two of the conductor receiving chambers 24U, 24L. The upper and lower conductor receiving chambers 24U, 24L are arranged side by side as seen in FIG. 4. Each chamber 24U, 24L has a closed end 26 and a chambered opening 28 in one end face 16 of the block section 12. In alternate embodiments, the block section may have any suitable number of conductor receiving chambers formed therein with corresponding openings in one or more sides or ends of the block section. In other alternate embodiments, the block section may have several rows of conductor receiving chambers. The block section 12 also has contact holding receptacles 30 formed therein. As seen in FIGS. 3 and 4, the block section 12 could have eight of the contact holding receptacles 30. The contact holding receptacles 30 are shown disposed in two columns of four receptacles, though the receptacles may have any other suitable arrangement. Each contact holding receptacle 30 has an aperture 32 in the end face 18 opposite the conductor receiving chambers 28 of the block section 12. Each contact holding receptacle 30 terminates in a blind end 34. The contact holding receptacles 30, and contact receiving chambers 24U, 24L in the block section 12 may be separated from each other (see FIG. 4), although other arrangements (e.g. superposition) are possible. In alternate embodiments, the connector block section may have any suitable number of contact holding receptacles which may communicate with one or more of the conductor receiving chambers.

The conductor receiving chamber 24U, 24L in the block section 12 of the connector 10 are sized to generally conform to the diameter of the bare conductor 102 of the electrical cables 100. By way of example, the conductor receiving chambers 24U, 24L in the block section may have a diameter of about 0.075 inches to receive a No. 14 AWG conductor 102. In alternate embodiments, the conductor may have any other desirable size and the conductor receiving chamber in the block section may be sized to suit. The depth of the conductor receiving chambers 24U, 24L, is sized to provide adequate grip on the bare conductor 102U, 102L, when the conductor is connected to the connector 10. For example, in the preferred embodiment, the conductor receiving chamber 24 for a No. 14 AWG conductor may be about 0.25 inch deep. The conductor receiving chambers 24U, 24L are located proximate to the faces 20T, 20B, 22 of the block section 12 such that displacement or indention of the faces deforms the conductor receiving chambers 24U, 24L.

The contacts 14 of the connector 10 may be pin or receptacle contacts made from a suitable conductive material such as brass, tellurium copper, or phosphor bronze (only the tail portion 40 of contacts 14 are shown in FIGS. 1–4). The contacts 14 have a mounting, or tail portion 40 which is held in an interference fit within the block section 12 to secure the contacts to the block section of the connector. The tail portion 40 of the connector 14 is resiliently compliant for resiliently complying with the contact holding receptacles 30 in the block section 12. For example, the tail portion 40 of each contact 14 may comprise the generally cylindrical shell 42 (see FIG. 1). The shell 42 has a longitudinal slot 44. The slot 44 allows the cylindrical shell 42 forming the tail portion 40 of the contact 14 to resiliently flex inwards when subjected to radial compression. In alternate embodiments, the shell forming the tail portion of the contacts may have two or more longitudinal slots to form a number of cantilevered spring arms allowing the tail portion to comply with mating receptacles in the block section of the connector. In still other embodiments, the tail portion may have any other suitable configuration, such as for example spring-loaded detent surfaces, which comply with the mating receptacles in the block section. The tail portion 40 of the contacts 14 have a predetermined length to conform to the contact holding receptacle 30 and the block section 12.

The electrical connector 10 is manufactured substantially as described below. The connector block section 12 is cut, machined, cast or otherwise formed by any other suitable method from stock material to a predetermined size suitable for interface with the bare conductors 102 of desired size. For example, in the case where the conductor 102U, 102L is a No. 14 AWG conductor, the block section 12 of the conductor may be about 0.5 inch in length, having a height of about 0.37 inch, and a width of about 0.15 inch. The aforementioned dimensions of the block section for the connector are merely exemplary, and in alternate embodiments, the block section of the connector may have any other suitable dimensions. The conductor receiving chambers 24U, 24L and the contact holding receptacles 30 can be bored into opposite end faces 16, 18 of the block section 12 (or could be created during initial manufacture of block 12). The conductor receiving chambers 24U, 24L and the contact holding receptacles 30 are formed by any suitable material removing process (e.g. drilling) for boring into malleable metal such as that making up the block section 12 of connector 10. To terminate the power cables 100 to the block section 12 of the connector 10 the insulation 104 on each cable is stripped to expose the bare conductors 102U, 102L (see FIG. 1) using known techniques. The bare conductor 102U, 102L of each cable is inserted into the corresponding conductor receiving chamber 24U, 24L, preferably, until in contact with the blind end 26 of the chamber 24U, 24L. The bare conductor 102U, 102L, is then crimped in the block section 12 connecting the cables 100 to the block section 12. Each conductor 102U, 102L may be crimped independently, or both conductors 102U, 102L may be crimped at substantially the same time. For example, the upper conductor 102U may be crimped inside the block section 12 by forming an indentation 46 in the top face 20T of the block section 12. As shown in FIG. 4, the indentation 46 in the top 20T of the block section is sufficiently deep for deforming the upper conductor receiving chamber 24U to crimp the conductor 102U in the chamber. The indentation 46 is preferably cold formed by pressing a suitable die or punch (not shown) into the top face 20T using a suitable benchtop press. Under sufficient pressure from the crimping tool (not shown), the die displaces material in the top face 20T forming the indentation 46 in the face and deforming to the inside of the chamber 24U to compress the conductor 102U within. As shown in FIG. 2, further indentations 50U for crimping the conductor 102U in the upper conductor receiving chamber 24U may be formed in the sides 22 of the block section 12. Indentations 550U may be formed in both side faces 22 or only in one of the block side faces as desired. The indentations 50U in side faces 22 are substantially aligned with the upper conductor receiving chamber 24U so that the indentations 50U deform the upper chamber 24U. The indentations 50U in the sides 22 are formed substantially similar to indentation 46 in the top face 20T by cold pressing a die, with a crimping tool, into the side of the block to deform the conductor receiving chamber 24U. In the case where indentations 50U are formed in both sides 22 of the block, then two dies may be held in the opposing jaws of the crimping tool (not shown) and substantially simultaneously pressed into the sides 22 to form the indentations at substantially the same time. The indentations 50U in one or both sides 22 of the block section may be used in combination with indentation 46 in the top face 20T to crimp the conductor 102U in the upper chamber 24U. Otherwise, if desired, the indentation 46 in the top face 20T, or indentation 50U in one or both sides 22 of the block section 12 may be used alone to clamp the conductor 102U in the upper chamber 24U. To crimp the lower conductor 102L in the lower conductor receiving chamber 24L, the above process is substantially repeated. With the bare conductor 102L in the lower chamber 24L, the chamber is deformed by either cold forming indentation 48 in the bottom face 20B along with one or more indentations 50L in the sides 22 of the block section. Otherwise, the conductor 102L may be clamped in the lower chamber 24L by cold forming only indentation 48 in the bottom 20B of the block section. Indentation 50L in one or both sides 22 of the block section (only one indentation is shown in FIG. 2) is substantially aligned with the lower chamber 24L deforming the chamber when being formed by pressing the die shape into the sides 22 of the block 12. The bottom indentation 48 is formed by cold pressing the die into the bottom face 20B of the block. The conductors 102U, 102L respectively in the upper and lower chambers 24U, 24L may be crimped at substantially the same time by pressing dies, located in opposing jaws of the crimping tool, into the top and bottom faces 20T, 20B of the block section at substantially the same time. Deformation of the conductor receiving chambers 24U, 24L by indentations 46, 48, 50U, 50L in the faces of the block section crimps the conductors 102U, 102L within the corresponding chambers thereby clamping the conductors to the block section on a substantially permanent basis. The clamping forces generated by deformed chambers 24U, 24L on the corresponding conductors 102U, 102L preferably resist pull out forces on the conductors, as indicated by arrows P in FIG. 4, having magnitudes approaching the failure strength of the conductors 102U, 102L. The clamping generated by deformed chambers 24U, 24L on the respective conductors also effects good electrical contact between the conductors and block section thereby providing an interface to the wire conductors.

The respective contacts 14 of the connector 10 may be mounted on the block section 12 at any time prior to or after connection of the cables 100 to the block section. Each contact 14 is mounted in a corresponding contact holding receptacle 30 in the block section. The contacts may be inserted in any desirable order. To mount the contacts 14 on the block section, the resiliently compliant tail section 40 of each contact is inserted into the corresponding contact holding receptacle 30 of the block section. Insertion of the resiliently compliant tail section 40 into the contact holding receptacle 30 resiliently compresses the tail section inwards. Correspondingly, the compressed tail section 40 of the contact is biased against the contact holding receptacle generating friction holding forces between the contact tail 40 and the receptacle 30. The resilient bias between compliant tail section 40 and the receptacle 30 also effects an electrical contact between the contact 14 and block section. When the contacts 14 are mounted in the block section 12 and the conductors 102U, 102L are crimped to the block section 12, the block section 12 effects an electrical and mechanical connection between conductors 102U, 102L and contacts 14 of the connector 10. Additionally, the connector housing could have features, such as shoulders, to help retain contacts 14 within block 12.

Figure 5A:
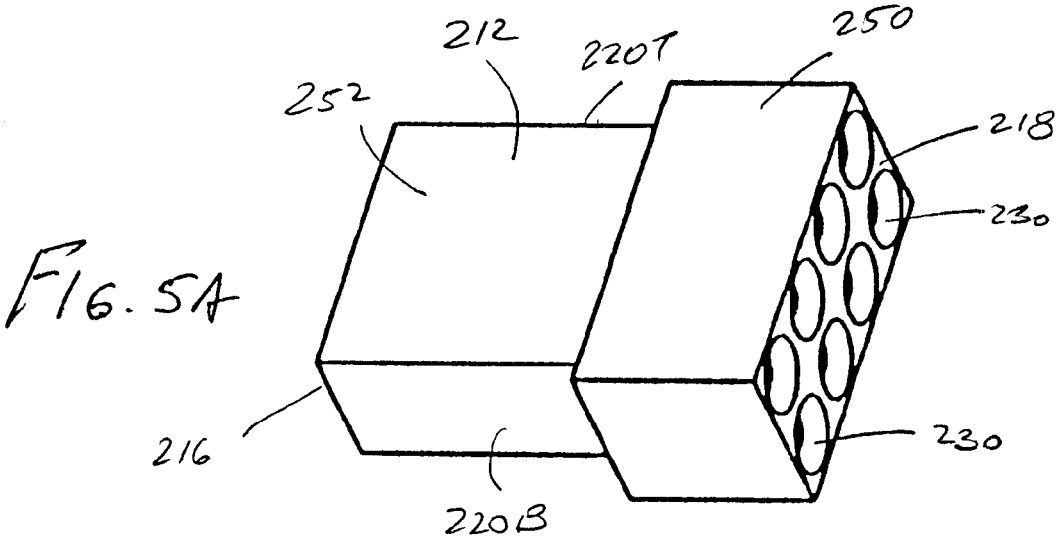
FIGS. 5A–5B are respectively a perspective view and an end elevation view of an interface block section of an electrical connector in accordance with a second preferred embodiment of the present invention.
Figure 5B:
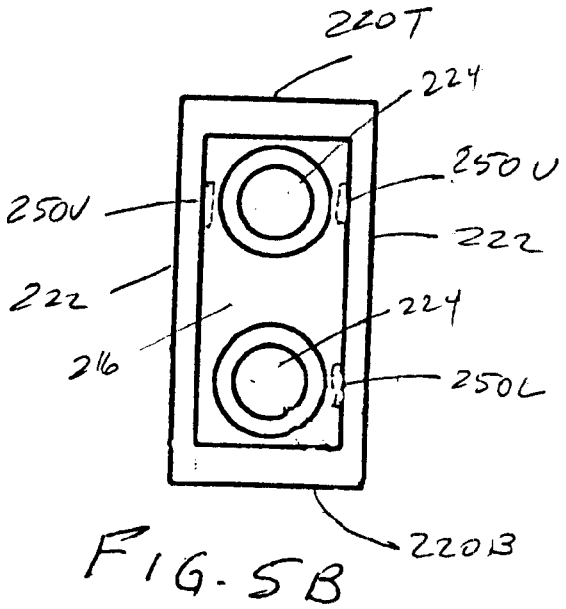

Referring now to FIGS. 5*a*–5*b*, there is shown an interface block section 212 for an electrical connector in accordance with a second preferred embodiment of the present invention. The interface block section 212 is similar to block section 12 described above and shown in FIGS. 1–4. Similar features in FIGS. 5*a*–5*b* are numbered similarly to features shown in FIGS. 1–4. In this embodiment, the block section 212 is also a one- piece member made from a conductive material, preferably a soft or malleable metal such as tellurium copper, phosphor bronze, or brass.

The block section 212 includes a contact holding section 250 and a conductor holding section 252 depending therefrom. In alternate embodiments, the contact holding section may be smaller than the conductor holding section of the block. The contact holding section 250 contains contact holding receptacles 230 with openings at one end 218 of the block section 212. Conductor receiving chambers 224 are located in the conductor holding section 252 with openings at another end, preferably the opposite end 216, of the block section 212. The bare conductors of the cables are inserted into the conductor receiving chambers 224, and indentations 250U, 250L are formed in the sides 222 of the block section to deform the chambers and crimp the conductors therein. Indentations (not shown) may also be formed in the top 220T or bottom 220B of the block section to crimp the conductors in the corresponding chambers 224. Contacts (not shown) are mounted to the block section 212 by inserting the compliant tail portions of the contacts (similar to contacts 14 shown in FIGS. 1 and 4) into the corresponding contact holding receptacles 230 of block section 212. In this manner the block section 212 provides a substantially permanent interface between conductors and the contacts.

The present invention provides an electrical connector 10 with an interface block 12, 212 connecting bare conductors 102U, 102L of cables 100 to contacts 14 of the connector. To interface the conductors 102U, 102L to the contacts, the conductors 102U, 102L are inserted into chambers 24U, 24L of the block section 12, 212 and then crimped to the block section by forming indentations into the sides or top and bottom of the block section 12, 212 which is preferably made from soft metal. The compliant tail portions 40 of contacts 14 are inserted into the block section to complete the interface with the conductors. Hence, in the present invention, the conductors need not be crimped directly to the connector contacts 14 to provide an electrical connection therebetween. This is especially advantageous in comparison to conventional connectors wherein direct contact between conductors and contacts is used to effect a connection therebetween. In conventional connectors, the contacts are provided with a tail section having interfacing features, such as bendable tabs, to allow the conductor to be crimped or otherwise attached directly to the contact. These features are time consuming to produce especially for contacts interfacing with small conductors. In addition, due to their small size, these conductor crimping features of contacts in conventional connectors are susceptible to damage during connection of the conductors to the contacts. This may result in an improper or inefficient interface between conductor and contacts which may fail during use. The present invention eliminates the contact to conductor interface problems of conventional connectors. The interface block section 12, 212 of the connector in the present invention provides a very robust connection between contact and conductor which is inexpensive to manufacture. The block section 12, 212 which is a one piece member, is easily manufactured. Furthermore, crimping of the conductors 102U, 102L to the block section 12 is also fast and easy. The block section 12 is not prone to failure during crimping and may generate much higher clamping forces on the conductors in comparison to the crimp tabs on contacts and conventional connectors. The higher clamping forces provide a better electrical contact and stronger mechanical connection in the connector of the present invention. The contacts 14 of the instant connector 10 may not have features for crimping the conductor, and hence, may be less expensive to manufacture and install in the connector 10 than contacts in conventional connectors. Therefore, the conductor interface provided by the electrical connector 10 of the present invention is more robust, with an improved electrical connection which is less time consuming and less costly to manufacture than conventional connectors.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for forming an electrical interface for an electrical cable, the method comprising the steps of:

providing an electrical power connector having an electrically conductive block section with at least one substantially flat side, and two conductor receiving hole formed in a first end of the block section;

providing the block section with contact receiving holes formed into a second end of the block section;

inserting a bare conductor of the electrical cable into one of the conductor receiving holes of the block section; and crimping the block section, the block section being made from a deformable conductive material wherein crimping the block section comprises indenting the at least one substantially flat side which deforms at least one of the conductor receiving holes clamping the conductor inside conductor receiving the hole.

2. A method in accordance with claim 1, further comprising the step of inserting contact members into the contact receiving holes in the second end of the block section.

3. A method in accordance with claim 2, wherein each of the contact members have a compliant tail section, the compliant tail section being received in and complying with an interior surface of a corresponding one of the contact receiving holes when the contact member is inserted into the corresponding contact receiving hole.

4. A method in accordance with claim 1, wherein the block section is a one piece member made from brass or tellurium copper.

5. A method in accordance with claim 1, wherein the conductor receiving holes are blind holes, and wherein each of the contact receiving holes formed in the second end opposite the conductor receiving hole is a blind hole.

6. A method in accordance with claim 1, wherein the step of crimping comprises pressing a die shape against the substantially flat side of the block section for forming an indentation into the side, the indentation in the side of the block section deforming the conductor at least one of receiving holes and clamping the conductor inside the conductor receiving hole.

7. A method for manufacturing an electrical power connector, the method comprising the steps of:

forming an electrically conducting block from a deformable conductive material, the conducting block being a one piece member, the conducting block being provided with a substantially flat side;

forming contact receiving holes in a first end of the conducting block; and forming two conductor receiving holes for receiving conductors therein into a second end of the conducting block, at least one of the conductor receiving holes being formed proximate to the flat side of the conducting block wherein an indentation pressed into the flat side of the conducting block deforms one of the conductor receiving holes and crimps the conductor located inside the conductor receiving hole.

8. A method in accordance with claim 7, wherein the conducting block is made from brass or tellurium copper.

9. An electrical connector comprising an electrically conductive interface block, and contacts, the interface block having a first end with two conductor receiving holes formed therein, a second end with contact receiving holes formed therein, and a side disposed adjacent to at least one of the conductor receiving hole, wherein the interface block is made from malleable metal, and wherein the side adjacent the conductor receiving hole is indented for crimping a conductor located inside the conductor receiving hole;

wherein the conductor receiving holes are blind holes, the contact receiving holes are blind holes separate from the conductor receiving hole, and the interface block effects an electrical connection between the contacts in the contact receiving holes and the conductor in the conductor receiving hole.

10. An electrical connector in accordance with claim 9, wherein the interface block is a one piece member made from brass or tellurium copper.

11. An electrical connector in accordance with claim 9, wherein the side of the interface block is adjacent to both conductor receiving holes, and is indented in two locations corresponding to the respective conductor receiving holes, each indentation respectively crimping the conductor located in the corresponding conductor receiving hole.

12. An electrical connector in accordance with claim 9, wherein the interface block has two sides, each side being adjacent to a corresponding one of the conductor receiving holes, and each side being indented to crimp the conductor located in the corresponding conductor receiving hole.

13. An electrical connector in accordance with claim 9, wherein the side of the interface block is indented by cold pressing a die into the side, and wherein the indented side deforms the conductor receiving hole and crimps the conductor located inside the hole.

14. An electrical connector in accordance with claim 9, further comprising contacts connected to the interface block, wherein each of the contacts has a resiliently compliant tail section located in and complying with a corresponding one of the contact receiving holes.

15. An electrical power connector comprising an electrically conductive block section, the block section having two bore formed in one end for receiving bare conductors therein, and having contact receiving holes in another end of the block section for receiving contacts, wherein the block section has a substantially flat side with an indentation formed by cold pressing a die shape into the side of the block section, the indentation in the side of the block section deforming the bores for crimping a conductor located in the bore to the block section.

16. An electrical connector in accordance with claim 15, wherein the block section is a one piece member made from soft metal.

17. An electrical connector in accordance with claim 15, rectangular cross-section at the end with the bore for receiving the conductor therein.

* * * * *